US006142453A

United States Patent [19]

Martin

[11] Patent Number: 6,142,453

[45] Date of Patent: Nov. 7, 2000

[54] FENCE SYSTEM

[76] Inventor: Matthew Martin, Rt. 2, Box 575, Green Forest, Ark. 72638

[21] Appl. No.: 09/120,638

[22] Filed: Jul. 22, 1998

[51] Int. Cl.[7] ..... E04H 17/24

[52] U.S. Cl. ..... 256/65; 256/59; 256/68

[58] Field of Search ..... 256/59, 65, 68, 256/69, 60, 73, 21, 22, 24, 25, 26, 19

[56] References Cited

U.S. PATENT DOCUMENTS

| | | | |
|---|---|---|---|
| 122,952 | 1/1872 | McDonald . | |
| 204,246 | 5/1878 | Pierce . | |
| 218,229 | 8/1879 | Carpenter . | |
| 277,708 | 5/1883 | Gorla . | |
| 339,368 | 4/1886 | Black et al. | 256/21 X |
| 351,194 | 10/1886 | McDougall . | |
| 534,389 | 2/1895 | Duncan | 256/24 |
| 693,061 | 2/1902 | Pegg . | |
| 745,153 | 11/1903 | Childress . | |
| 818,672 | 4/1906 | Trautwein . | |
| 1,038,470 | 9/1912 | Woodford | 256/26 |
| 1,316,155 | 9/1919 | Harrison et al. | 256/65 |
| 2,222,249 | 11/1940 | Borgen | 256/48 |
| 2,517,959 | 8/1950 | Baldwin | 256/21 |
| 3,107,900 | 10/1963 | De Paolo | 256/65 |
| 4,252,313 | 2/1981 | Skalka | 256/65 X |
| 4,619,440 | 10/1986 | Thevenin et al. | 256/47 |
| 5,301,926 | 4/1994 | Sharp | 256/24 |
| 5,354,037 | 10/1994 | Venegas, Jr. | 256/59 |

FOREIGN PATENT DOCUMENTS

| | | | |
|---|---|---|---|
| 164091 | 3/1955 | Australia | 256/21 |
| 45118 | 2/1939 | Netherlands | 256/21 |
| 1259989 | 1/1972 | United Kingdom | 256/21 |

*Primary Examiner*—Harry C. Kim

*Attorney, Agent, or Firm*—Brent A. Capehart; Fellers, Snider, Blankenship, Bailey & Tippens

[57] ABSTRACT

A fence system which uses externally threaded connector rods, rails with externally threaded ends and internally threaded couplings to join the connector rods to the rails is described. A method for building the fence system is also provided.

15 Claims, 4 Drawing Sheets

FENCE SYSTEM

CROSS-REFERENCE OF RELATED APPLICATION

Not applicable.

BACKGROUND OF THE INVENTION

1. Field of the Invention

The present invention relates to a fence system and a method for constructing the fence system.

2. Description of the Related Art

Fences and methods for constructing them are well known in the prior art. Examples of U.S. patents directed to such structures are as follows.

Paisley U.S. Pat. No. 192,276 discloses a fence post with openings to receive rods or fence rails. The rails may consist of wire or iron rods.

Rossiter U.S. Pat. No. 4,542,885 discloses a fence system with fence post having openings at various levels, for freely receiving fence rails. The fence post consists of a channel made of extruded metal.

Thevenin et al. U.S. Pat. No. 4,619,440 discloses a wire fence having an elongated stake for supporting a horizontal wire.

U.S. Pat. No. 277,708 to Gorla discloses an improvement fence post having an anchor by means of which it may be secured in the ground. The fence rails are wire and are supported on the fence posts by hooks having threaded ends.

U.S. Pat. No. 2,222,249 to Borgen discloses a metal fence post with a plurality of slots.

U.S. Pat. No. 351,194 to McDougall discloses a fence system with metallic posts connected by rods or wires.

These and other prior art are listed in the table below.

| U.S. Pat. No. | Date | Patentee | Title |
|---|---|---|---|
| 122,952 | 1/23/1872 | McDonald et al. | Improvement in Iron Telegraph Poles |
| 192,276 | 6/19/1877 | Paisley | Fence |
| 204,246 | 5/28/1878 | Pierce | Fence-Post |
| 218,229 | 8/5/1879 | Carpenter | Iron Fence-Post |
| 277,708 | 5/15/1883 | Gorla | Fence Post |
| 351,194 | 10/19/1886 | McDougall | Fence Post |
| 693,061 | 2/11/1902 | Pegg | Fence Post |
| 745,153 | 11/24/1903 | Childress | Fence Post |
| 818,672 | 4/24/1906 | Eck et al. | Fence Post |
| 2,222,249 | 11/19/1940 | Borgen | Steel Fence Post |
| 4,542,885 | 9/24/1985 | Rossiter | Metal Fence Post |
| 4,619,440 | 10/28/1986 | Thévenin et al. | Fencing Device, A Stake, A Fastener and an Assembly Part for Such a Device |

There have been many fence systems with various support posts, railings and gates. However, many of these fence systems have been difficult for a single person to construct. Also, many fence systems require the use of welding equipment, which is difficult to transport in the field. Furthermore, many of these fence systems require the use of specialty fence parts which may be difficult to find when the fence part breaks twenty or more years after the fence has been installed.

SUMMARY OF THE INVENTION

The present invention is for a fence system and a method of installing the fence system. The components of the fence system and methods specified are directed to one-man installation of the fence system.

An important feature of the fence system is the use of threaded connector rods, which are installed in openings in the side posts and terminal posts (collectively, referred to herein as the fence posts). The threaded connector rods are attached to the fence posts by tightening connector rod nuts on the threaded connector rods against the fence posts. In some embodiments, lock washers are placed between the connector rod nuts and the fence posts, to prevent external forces on the fence system from loosening the connector rod nuts.

Rails with externally threaded circular ends are located between the threaded connector rods, coupling to the connector rods with internally threaded couplings. These couplings are common hardware items. The rails may be completely threaded or threaded only at the ends.

The fence system of the present invention also has top posts in some embodiments. For these embodiments, the top posts are connected to side posts by T-connectors and to terminal posts by L-connectors.

The fence system of the present invention also accommodates sloping portions of ground by providing angle couplings and angle post T-connectors. This prevents the fence system from having a large gap beneath the bottom rail, which may allow the escape of livestock.

In some embodiments, there are gates and gate support sections to control the access of people and livestock to and from the area enclosed by the fence system.

Three-ring connectors are used to join terminal posts. A terminal post is a post that is connected by rails and threaded connector rods to only one side post or terminal post. At the intersection of two straight-line portions of the fence system, the two straight-line portions end by providing two terminal posts close to each other. The three-ring connectors provide a barrier between the terminal posts to prevent the passage of people and animals.

A spacer bar is used to position an adjacent fence post to an existing fence post. One places a spacer bar ring over an existing fence post and then sets the position of the adjacent fence post by placing the adjacent fence post in a second spacer ring by either: (1) driving the fence post into the ground; or (2) marking the adjacent post position and digging a hole at the marked position to receive the fence post.

A principal object of the present invention is to provide a fence system to serve as a barrier for livestock and people.

Another object of the invention is to provide a fence system useful to mark the boundaries of one or more pieces of property.

Yet a further object of the present invention is to provide a fence system which is able to withstand a variety of elements of nature, but which is still attractive to the eye.

A further object of the invention is to provide a fence system which is easy to assemble and disassemble by one person.

Yet another object of the invention is to provide a fence system, the components of which are inexpensive to replace.

A still further object of the invention is to provide a fence system, the parts of which are commonly sold in hardware and building supply stores.

Still another object of the invention is to provide a fence system which is economical to construct.

DETAILED DESCRIPTION OF THE PREFERRED EMBODIMENTS

Figure 1:
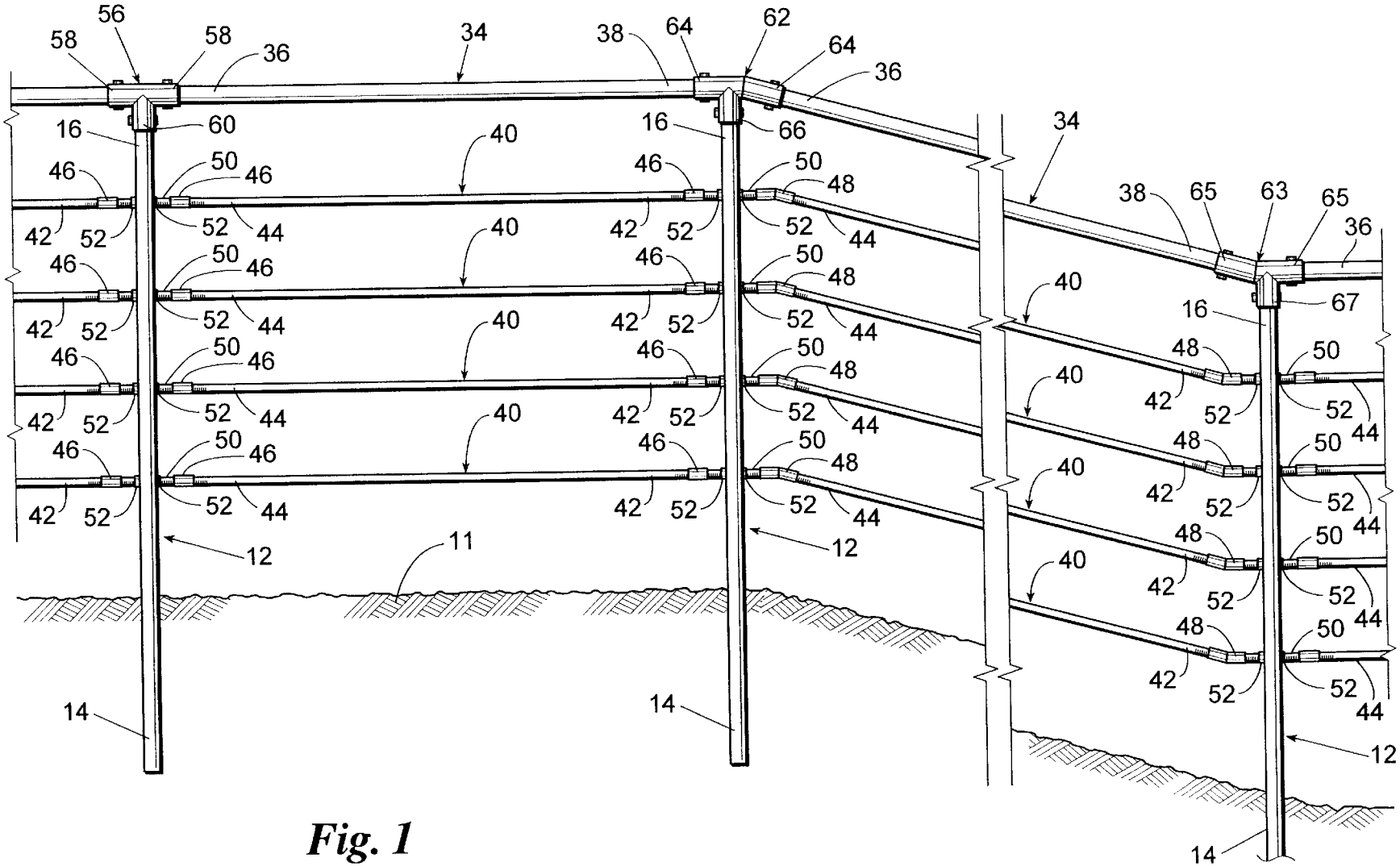
FIG. 1 shows is an elevational view of a fence section of the present invention.

Referring to FIG. 1, a fence system 10 is shown having a plurality of side posts 12 connected to a top post 34 and a plurality of rails 40 therebetween. Each side post 12 has a bottom 14 and a top 16. The side post bottoms 14 are buried in ground 11. Post T-connectors 56 are on top of each side post 12, with the side post tops 16 fitting into T-connector side post openings 60. Top posts 34 extend between post T-connectors 56. Each top post 34 has a left end 36 and a right end 38, which fit into T-connector top post openings 58. Each side post 12 has openings 18 (shown in FIG. 2) extending through the side post 12, for receiving connector rods 50. The connector rods 50 are inserted into the side post openings 18, such that the connector rods 50 are approximately bisected by the side posts 12. Lock washers are placed on the connector rods 50 on either side of the side posts 12. Nuts 52 are placed on each end of the connector rods 50. The nuts 52 are tightened against the lock washers, which lock against the side post. After the connector rods 50 are installed on adjacent side posts 12, internally threaded couplings 46 are installed on each end of the connector rods 50.

Still referring to FIG. 1, rails 40 are installed between internally threaded couplings 46. Each rail 40 has a circular externally threaded left end 42 and a circular externally threaded right end 44. The rails 40 are installed between the connecting rods 50, by mating the externally threaded ends with the internally threaded couplings 46.

Still referring to FIG. 1, angle post T-connectors 62 are on top of the side posts 12. After the connector rods 40 are installed on side posts 12, internally threaded couplings 46, and angle couplings 48 are installed on each end of the connector rods 50. The combination of angled T-connector 62 and angled couplings 48 allows fence system 10 to accommodate a downward or upward slope in the ground 11.

Figure 2:
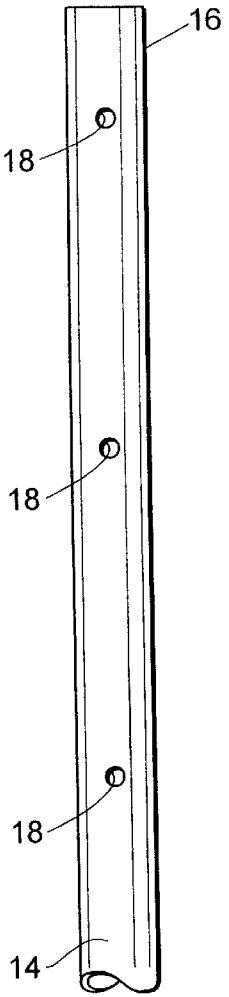
FIG. 2 is an elevational view of a side post of the present invention.

In FIG. 2, side post 12 has a top 16, a bottom 14 and side post openings 18. In the side post 12, the openings 18 receive the connector rods 50 (shown in FIG. 1).

Figure 3:
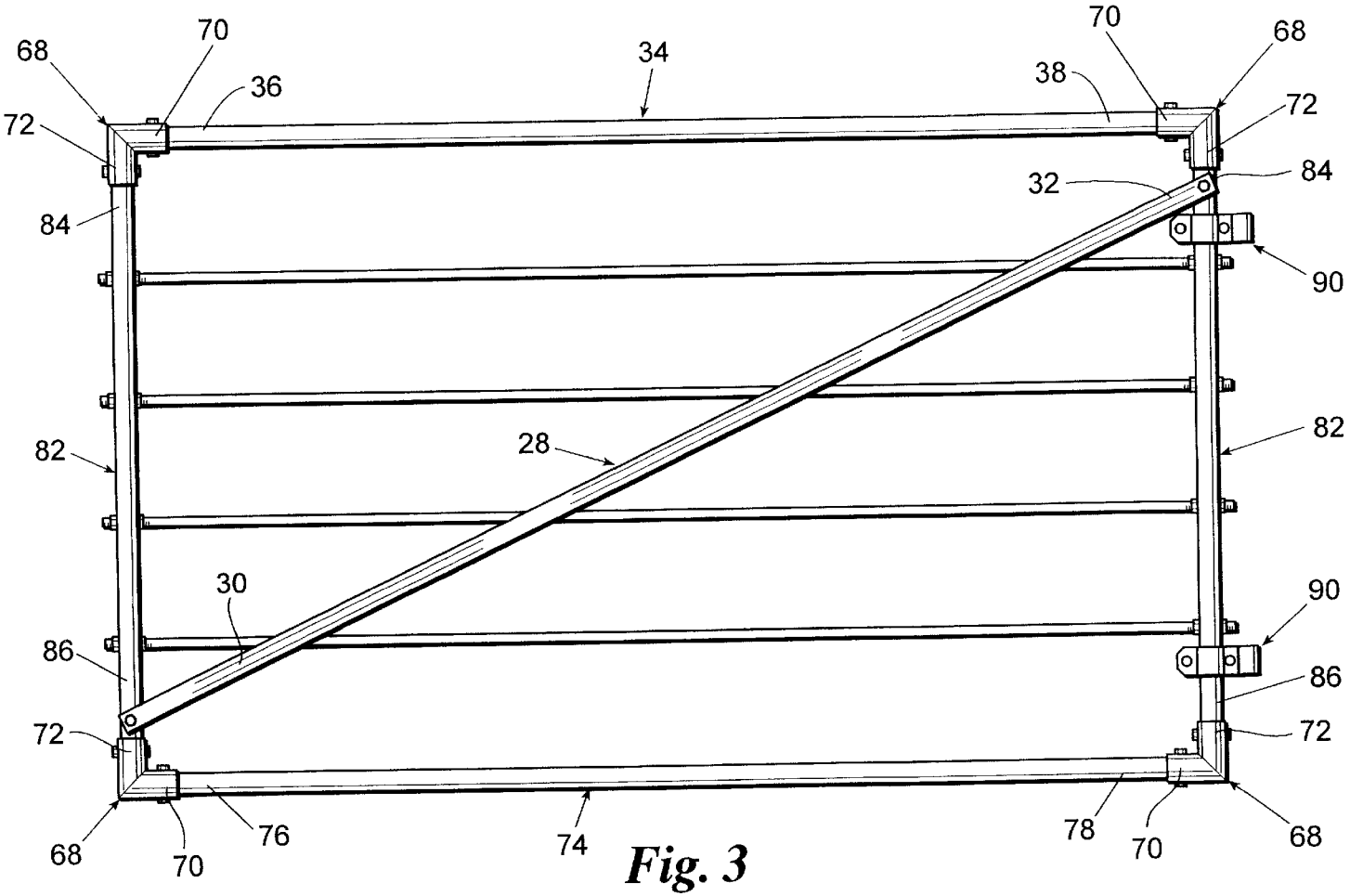
FIG. 3 is an elevational view of a gate of the present invention.

In FIG. 3, gate 80 is shown suspended in the air. The gate 80 has bottom post 74, side posts 82, and top post 34. The gate side posts 82 have post L-connectors 68 at the top and bottom of the side posts 82, with the gate side posts 82 fitting into L-connector side post openings 72. Top post 34 extends between post L-connectors 68, fitting into L-connector top post openings 70. Bottom post 74 extends between L-connectors 68, fitting into an inverted L-connector top opening 70.

Still referring to FIG. 3, stabilizer 28 is bolted to side post 82 in a diagonal with respect to a frame formed by the gate side posts 82, top post 34 and gate bottom post 74. Gate hinges 90 are attached to the side post 82.

Figure 4:
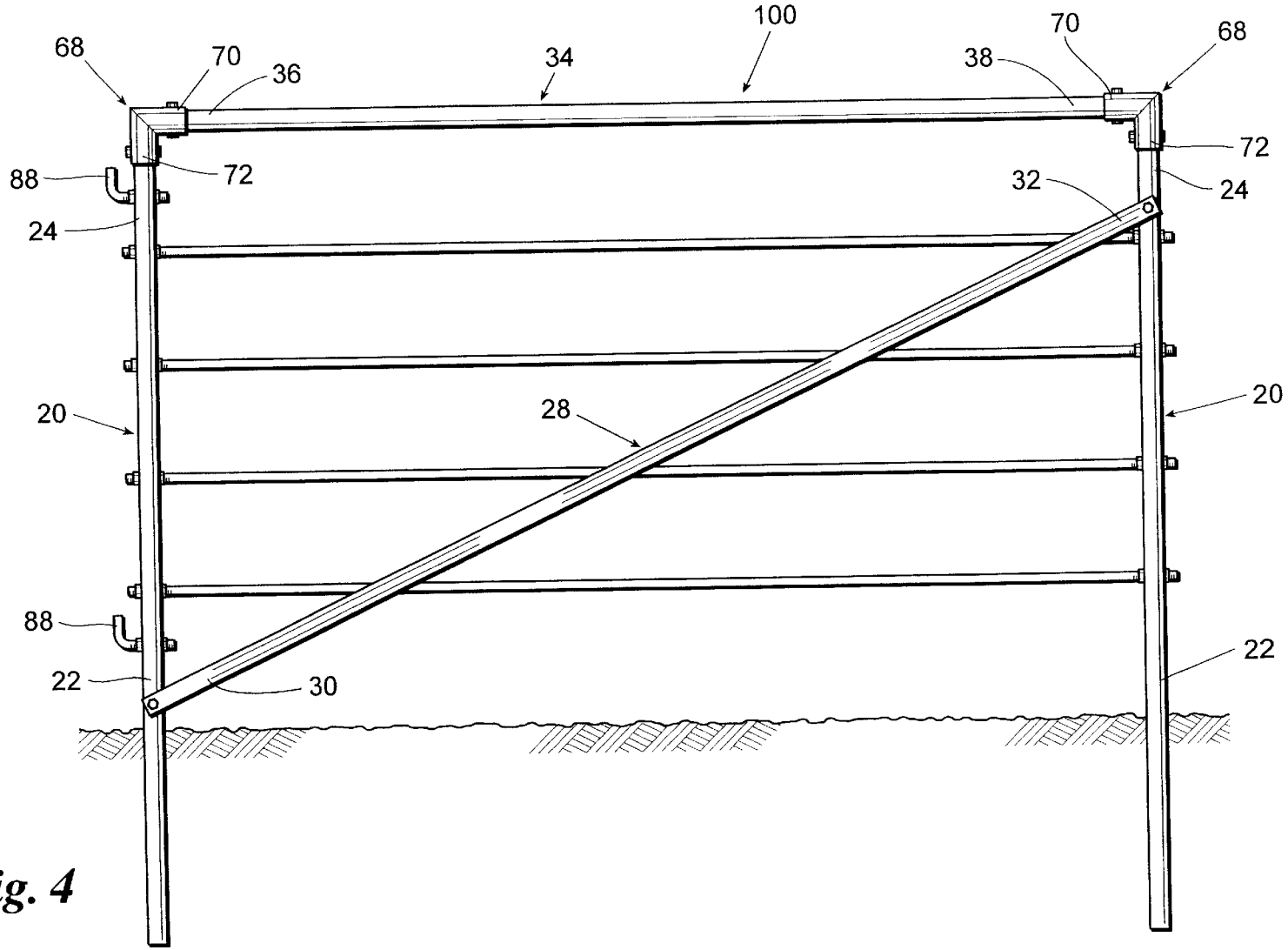
FIG. 4 is an elevational view of a gate support section of the present invention.

Referring now to FIG. 4, a gate support section 100 is shown having a pair terminal posts 20 connected by top post 34 and a stabilizer 28. Terminal post 20 has a bottom 22 and a top 24. Terminal post 20 is structurally identical to side post 12, but the terminal post 20 is used differently in the fence system 10. Terminal post bottom 22 is buried in the ground 11. Post T-connector 56 is on top of side post 12, with the side post top 16 fitting into T-connector side post opening 60. Post L-connector 68 is on top of terminal post 20, with the terminal post top 24 fitting into L-connector terminal post opening 72. Each top post 34 has a left end 36 and a right end 38. A top post 34 extends between terminal post 20 and side post 12, fitting into L-connector top post opening 70 at the top post left end 36 and into a T-connector top post opening 58 at the top post right end 38. Stabilizer 28 is bolted to side post 82 in a diagonal with respect to a frame formed by the gate side posts 82, top post 34 and gate bottom post 74. Gate hinges 90 are attached to the side post 82. Gate hangers 88 are bolted to terminal post 20. Referring briefly to FIG. 3, to hang the gate section 80, gate section 80 is lifted and then lowered onto gate hangers 88, which are shown in FIG. 4.

Figure 5:
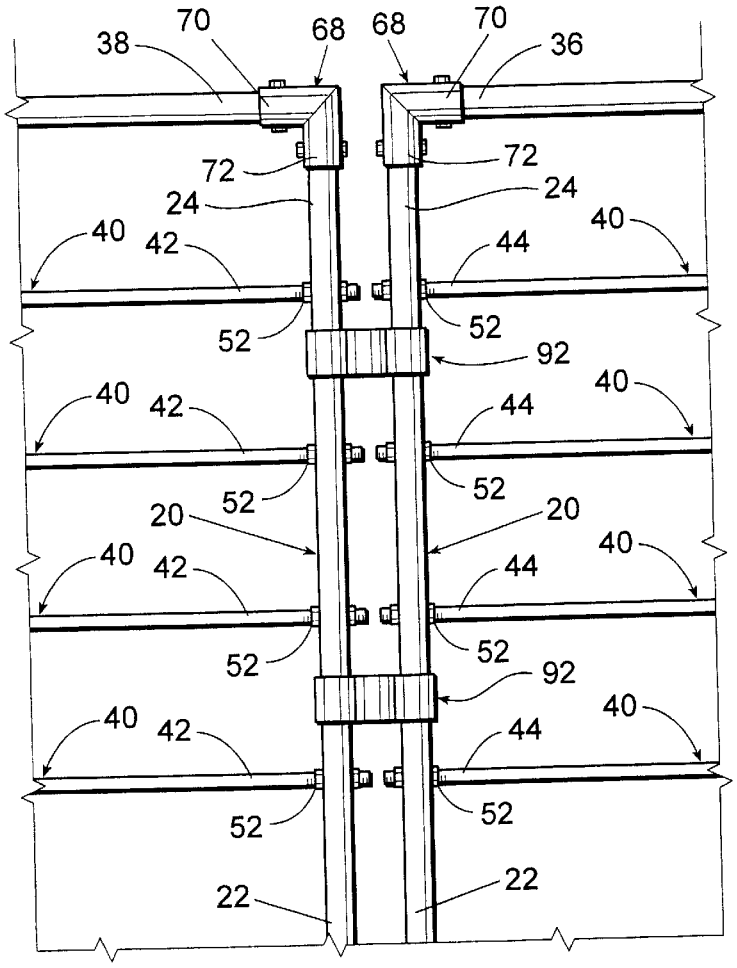
FIG. 5 is a perspective view of fence sections joined by a three-ring connector of the present invention

In FIG. 5, two terminal posts 20 are shown connected by a three-ring connector 92. For the three-ring connector 92, ring 98 (shown in FIG. 6) slides over a terminal side post 20 and ring 94 (shown in FIG. 6) slides over another terminal post 20.

Figure 6:
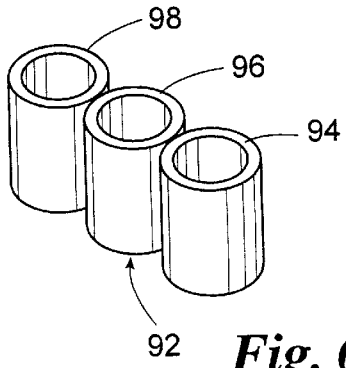
FIG. 6 is a perspective view of a three-ring connector of the present invention.

In FIG. 6, three-ring connector 92 is formed from first ring 94, second ring 96 and third ring 98. The three-ring connector 92 is used to connect terminal posts 20 to other terminal posts 20 or to side posts 12. The diameter of the rings 94, 96 and 98 are slightly larger than the diameters of the terminal posts 20, and side posts 12.

Figure 7:
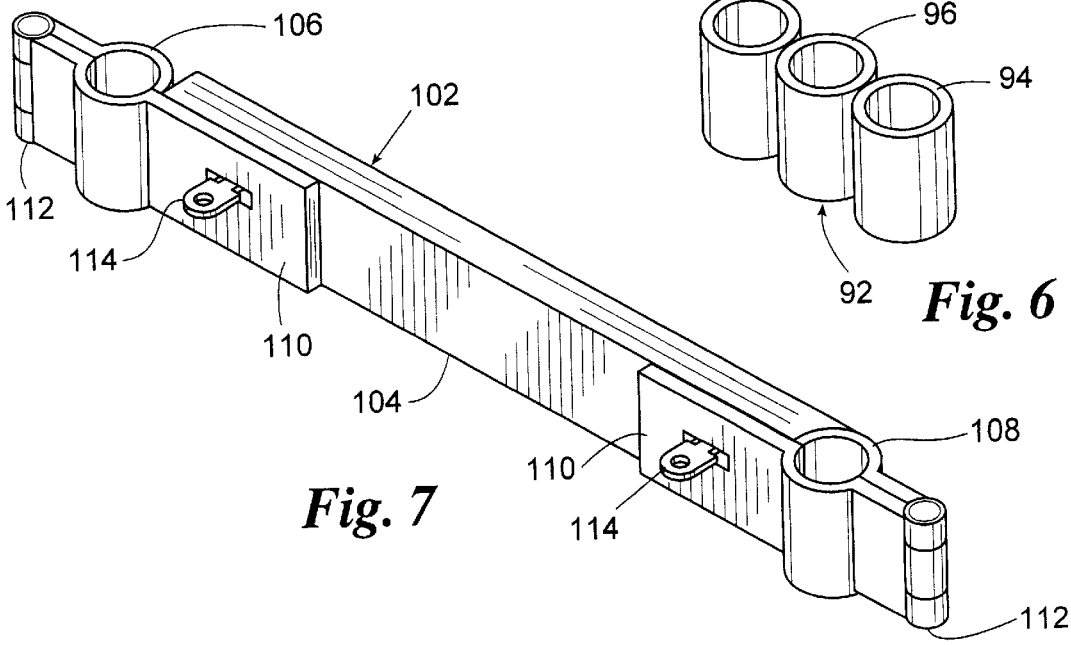
FIG. 7 is a perspective view of a spacer of the present invention.

FIG. 7 shows a post spacer 102 used to precisely set the position of an adjacent side post 12 with respect to an existing side post 12 or terminal post 20. Post spacer 102 has a spacer bar 104 and first end 115 having a first curved portion 116 and a second end 119 having a second curved portion 120. A securing plate 110 having a third curved portion 118 is connected to first end 115 by means of a hinge 112. An additional securing plate 110 is connected to second end 119 by means of a hinge 112. A first spacer ring 106 is created when first curved portion 116 is aligned with third curved portion 118. A second spacer ring 108 are created when the second curved portion 120 is aligned with third curved portion 118. A securing means such a latch 114 can be used to secure securing plate 110 to spacer bar 104.

To use the spacer 102 shown in FIG. 7, one must first have an existing side post 12 or terminal post 20 installed in the fence system. The position of adjacent side post 12 or terminal post 20 will be set using the spacer bar 102. The first spacer ring 106 is placed over the existing side post 12 or terminal post 20. The adjacent side post 12 or terminal post 20 is then placed into second spacer ring 108, and the position of the adjacent side post 12 or terminal post 20 is either: (a) marked on the adjacent side post 12; or (b) the adjacent side post 12 or terminal post 22 is driven into the ground 11.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims,, including the full range of equivalency to which each element thereof is entitled.

What is claimed is:

1. A fence system to be secured to the ground, said system comprising:

a plurality of threaded connector rods;

a plurality of substantially vertical posts, each of said substantially vertical posts having a bottom end, a top end and a body, wherein each body having a plurality of openings adapted to receive one of said plurality of threaded connector rods, said vertical posts being spaced apart and adapted to be secured to the ground;

a plurality of connector rod nuts, each of said plurality of connector rod nuts providing means to secure one of said plurality of threaded connector rods to one of said plurality of substantially vertical posts; and a plurality of rails, each of said plurality of rails having circular externally threaded ends, wherein each of said plurality of rails is positioned between two of said plurality of said substantially vertical posts and each of said externally threaded ends of each of said plurality of rails is threadedly secured by an internally threaded couplings to one of said plurality of threaded connector rods.

2. The fence system as recited in claim 1, further comprising:

a plurality of top posts, each of said plurality of top posts having a first end, a second end and a body and is adapted to be substantially parallel to the ground;

a plurality of post T-connectors, each of said plurality of said post T-connectors having a first top post opening, a second top post opening and a vertical post opening;

wherein each of said first and second top post openings being configured to receive a first end and second end of a one of said plurality of top posts; and wherein each said vertical post opening of each of said plurality of post T-connectors being configured to receive the top end of one of said plurality of substantially vertical posts.

3. The fence system as recited in claim 1, further comprising:

a plurality of top posts, each of which having a first end, a second end and a body; said top posts adapted to be horizontally aligned along a plane substantially parallel to the ground; and a plurality of post L-connectors, each of which having a third top post opening and a vertical post opening, said third top post opening being configured to receive a first end of one of said plurality of said top posts, and said vertical post opening of each of said plurality of post L-connectors being configured to receive the top end of one of said plurality of substantially vertical posts.

4. The fence system as recited in claim 1, further comprising:

a gate; said gate connected to a single vertical post by a plurality of gate hanger and gate hinge fasteners; and a gate support section hingedly supporting said gate.

5. The fence system as recited in claim 1, further comprising:

a plurality of top posts, each of said plurality of top posts having a first end, a second end and a body; said top posts adapted to be aligned along a plane substantially parallel to the ground;

a plurality of post T-connectors, each of said plurality of post T-connectors having a first top post opening, a second top post opening and a vertical post opening, said first top post opening being configured to receive a first end of one of said plurality of top posts, said second top post opening being configured to receive a second end of one of said plurality of top posts, and said vertical post opening of each of said plurality of post T-connectors being configured to receive the top end of one of said plurality of substantially vertical posts; and a plurality of post L-connectors, each of which having a third top post opening and a vertical post opening, said third top post opening receiving a first end of one of said plurality of top posts, and said vertical post opening of each of said plurality of post L-connectors being configured to receive the top end of one of said plurality of substantially vertical posts.

6. The fence system as recited in claim 1, further comprising:

a plurality of top posts, each of said plurality of top posts having a first end, a second end and a body; said top posts adapted to be aligned along a plane substantially parallel to the ground;

a plurality of angle post T-connectors to align each of said plurality of top posts along a plane substantially parallel to sloping portions of said ground, each of said plurality of angle post T-connectors having a first top post opening, a second top post opening and a vertical post opening, said first top post opening being configured to receive a first end of one of said plurality of top posts, said second top post opening being configured to receive a second end of one of said plurality of top posts, and said vertical post opening of each of said plurality of post T-connectors being configured to receive the top end of one of said plurality of substantially vertical posts; and a plurality of angle couplings to position said rails substantially parallel to said sloping portions of said ground.

7. The fence system as recited in claim 1, further comprising:

a plurality of three-ring connectors, each of said plurality of three-ring connectors adapted to receive between one and three of said plurality of substantially vertical posts.

8. The fence system as recited in claim 1, further comprising:

a plurality of top posts, each of said plurality of top posts having a first end, a second end and a body; said top posts adapted to be aligned along a plane substantially parallel to the ground;

a plurality of post T-connectors, each of said plurality of post T-connectors having a first top post opening, a second top post opening and a vertical post opening, said first top post opening being configured to receive a first end of one of said plurality of top posts, said second top post opening being configured to receive a second end of one of said plurality of top posts, and said vertical post opening of each of said plurality of post T-connectors being configured to receive the top end of one of said plurality of substantially vertical posts;

a plurality of post L-connectors, each of which having a third top post opening and a vertical post opening, said third top post opening receiving a first end of one of said plurality of top posts, and said vertical post opening of each of said plurality of post L-connectors being configured to receive the top end of one of said plurality of substantially vertical posts;

a plurality of three-ring connectors, each of said plurality of three-ring connectors adapted to receive between one and three of said plurality of substantially vertical posts;

a plurality of angle post T-connectors to align each of said plurality of top posts along a plane substantially parallel to sloping portions of said ground, each of said plurality of angle post T-connectors having a fourth top post opening, a fifth top post opening and a vertical post opening wherein said fourth top post opening being configured to receive a first end of one of said plurality of top posts, said fifth top post opening being configured to receive a second end of one of said plurality of top posts, said vertical post opening being configured to receive the top end of one of said plurality of substantially vertical posts; and a plurality of angle couplings to position said rails substantially parallel to said sloping portions of said ground.

9. A fence system to be secured to the ground, said system comprising:

a plurality of threaded connector rods;

a plurality of substantially vertical posts, each of said substantially vertical posts having a bottom end, a top end and a body, wherein each body having a plurality of openings adapted to receive one of said plurality of threaded connector rods, said vertical posts being spaced apart and adapted to be secured to the ground;

a plurality of connector rod nuts, each of said connector rod nuts providing means to secure one of said plurality of threaded connector rods to one of said plurality of substantially vertical posts;

a plurality of rails, each of said plurality of rails having circular externally threaded ends, wherein each of said plurality of rails are positioned between two of said plurality of said substantially vertical posts and each of said externally threaded ends of each of said plurality of rails is threadedly secured by an internally threaded couplings to one of said plurality of threaded connector rods;

a plurality of top posts, each of said plurality of top posts having a first end, a second end and a body; said top posts adapted to be aligned along a plane substantially parallel to the ground;

a plurality of post T-connectors, each of said plurality of post T-connectors having a first top post opening, a second top post opening and a vertical post opening, said first top post opening being configured to receive a first end of one of said plurality of top posts, said second top post opening being configured to receive a second end of one of said plurality of top posts, and said vertical post opening of each of said plurality of post T-connectors being configured to receive the top end of one of said plurality of substantially vertical posts; and a plurality of post L-connectors, each of which having a third top post opening and a vertical post opening, said third top post opening receiving a first end of one of said plurality of top posts, and said vertical post opening of each of said plurality of post L-connectors being configured to receive the top end of one of said plurality of substantially vertical posts.

10. The fence system as recited in claim 9, further comprising:

a plurality of angle post T-connectors to align each of said plurality of top posts along a plane substantially parallel to sloping portions of said ground, each of said plurality of angle post T-connectors having a fourth top post opening, a fifth top post opening and a vertical post opening wherein said fourth top post opening being configured to receive a first end of one of said plurality of top posts, said fifth top post opening being configured to receive a second end of one of said plurality of top posts, said vertical post opening being configured to receive the top end of one of said plurality of substantially vertical posts; and a plurality of angle couplings to position said rails substantially parallel to said sloping portions of said ground.

11. The fence system as recited in claim 9, further comprising:

a plurality of three-ring connectors, each of said plurality of three-ring connectors adapted to receive between one and three of said plurality of substantially vertical posts.

12. A method for building a fence system having a plurality of vertical posts, a plurality of top posts, a plurality of rails, a plurality of connector rods, a plurality of internally threaded couplings, a plurality of T-connectors, a plurality of L-connectors, a plurality of three-ring connectors and a spacer bar, wherein each of said plurality of vertical posts has a top end, a bottom end and a body with a plurality of openings therein, wherein the number of openings on each vertical post is the same, wherein each of said plurality of rails has two externally threaded ends, said method comprising the following steps:

(a) securing the bottom end of one of said plurality of vertical posts in ground such that said vertical post is substantially vertical;

(b) repeating step (a) until the desired number of vertical posts have been secured into the ground;

(c) inserting one of said plurality of connector rods into each of said openings of each of said secured vertical posts;

(d) positioning one of said plurality of rails between an adjacent pair of said secured vertical posts;

(e) coupling said positioned rail to said adjacent pair of secured vertical posts, said coupling effectuated by connecting each end of said positioned rail to one of said inserted connector rods by an internally threaded couplings;

(f) repeating steps (d) and (e) until each of said positioned rails has been secured to said secured vertical posts.

13. The method for building a fence system as recited in claim 12, further comprising:

(a) installing a gate support section having a vertical post; and (b) hingedly attaching a gate to said vertical post of said gate support section.

14. The method for building a fence system as recited in claim 12, further comprising:

(a) installing one of said plurality of three-ring connectors to between one and three of said secured vertical post.

15. A method for building a fence system as recited in claim 12 further comprising:

(a) using said spacer bar to space said secured vertical posts.

* * * * *